United States Patent [19]

Kaplan

[11] 4,120,243

[45] Oct. 17, 1978

[54] BUNDLE COMPACTOR

[75] Inventor: Irving Leonard Kaplan, Pepper Pike, Ohio

[73] Assignee: Carl Krasny & Associates, Inc., Warrensville Heights, Ohio

[21] Appl. No.: 782,494

[22] Filed: Mar. 29, 1977

[51] Int. Cl.[2] ..... B30B 5/04

[52] U.S. Cl. ..... 100/212; 100/3

[58] Field of Search ..... 100/1, 2, 3, 234, 212, 100/269 R, 7, 8; 53/198 R

[56] References Cited

U.S. PATENT DOCUMENTS

| | | | |
|---|---|---|---|
| 306,729 | 10/1884 | Elder | 100/212 |
| 987,740 | 3/1911 | Peterman | 100/212 |
| 3,427,959 | 2/1969 | Keil | 100/212 |
| 3,956,982 | 5/1976 | Hill | 100/212 |

FOREIGN PATENT DOCUMENTS

| | | | |
|---|---|---|---|
| 281,661 | 6/1931 | Italy | 100/212 |
| 127,667 | 1/1928 | Switzerland | 100/212 |
| 1,358,472 | 7/1974 | United Kingdom | 53/198 R |

*Primary Examiner*—Billy J. Wilhite

*Attorney, Agent, or Firm*—Maky, Renner, Otto & Boisselle

[57] ABSTRACT

A bundle compactor for elongated elements includes a plurality of aligned compacting units adapted to be used in conjunction with automatic stacking and strapping machines, each bundle compactor unit having a pair of coaxially pivotally mounted arms which are moved by a single piston-cylinder assembly from an open to a closed position through a crank and toggle links which lock the arms in closed position. A chain cinch trained over the distal ends of the arms completely encircles the bundle when the arms are closed and another piston-cylinder assembly tightens the cinch by moving a crank which includes rolls around which the cinch is trained, such rolls being thus moved away from a fixed anchor and fixed rolls for the cinch to tighten the cinch uniformly from each arm. At least one arm is bifurcated so that the other may move between the forked end of the one substantially completely to encircle the bundle with the cinch, the cinch also being bifurcated accordingly. A cyclically operated pressure intensifier is employed with the piston-cylinder assembly which tightens the cinch, the cyclical operation of which alternately increases and decreases the pressure in a ratio of about 3 to 1, respectively, until a predetermined maximum pressure is achieved. The compactor holds the bundle compacted until a strapping operation is completed.

40 Claims, 9 Drawing Figures

BUNDLE COMPACTOR

DISCLOSURE

This invention relates generally as indicated to a bundle compactor and more particularly to a bundle compactor adapted to be used with strapping machines for forming highly compact and secure bundles of elongated elements.

SUMMARY OF THE INVENTION

Conventional strapping machines, while able to exert considerable tension on the straps or bands, are not sufficient in and of themselves to maintain the bundle compact, particularly if the bundle is subject to vibration or rough handling during shipment. For example, if the bundle is dropped or in a railroad car which is humped, the elongated elements may tend to shift position and the band or strap may become loose.

Therefore, for the strapping machines to be fully effective, the bundle should be compacted to its desirable maximum density before the bands or straps are applied, and be held at such density while the bands or straps are applied. To assist strapping machines in this regard, compactors such as shown in U.S. Pat. No. 3,427,959 have been devised. However, in such prior art devices, the chain cinch employed cannot completely encircle the bundle resulting in an odd shaped compacted bundle which may be slightly of teardrop configuration. Again, mishandling of the bundle during shipment may result in the bands being loosened.

If the cinch employed to tighten the bundle completely encircles the same and is of a single strand, tension on the ends of the cinch will exert an undesirable twisting of the bundle elements. This can be demonstrated by wrapping a string around a pencil and pulling the ends. Accordingly, it is desirable that the compactor cinch substantially encircle the bundle and yet not exert any twisting force on the bundle.

Since minute movements of the elements of the bundle may tend to loosen the bands or straps applied thereto, it has been discovered that a more compact bundle can be formed by jolting or vibrating the compaction force to permit such minute movements during compaction. It has been discovered that this desirable result may be obtained by using a pressure intensifier which cyclically increases and, to a lesser extent, slightly relieves the pressure until a predetermined maximum compaction pressure is obtained.

With the present invention, there is provided a simplified arm support system for the compaction cinch which, when closed, will substantially encircle the bundle with the cinch and when the cinch is tightened, will apply a compaction force uniformly circumferentially of the bundle and symmetrically in a plane normal to the axis of the bundle. The arms are moved by a single piston-cylinder assembly to a closed position, each arm being toggle locked in such closed position. Another piston-cylinder assembly then tightens the cinch by moving a crank which includes rolls around which the cinch is trained, the rolls being moved away from a fixed anchor and fixed rolls so that the cinch is tightened uniformly from each arm. At least one arm is bifurcated so that the other may move between the forked end so that the cinch supported by the distal ends of the arms completely encircles the bundle and the compaction pressure obtained with the aforementioned cyclically operated pressure intensifier will uniformly compact the bundle with the compaction forces being symmetrically distributed about a plane normal to the axis of the bundle.

It is accordingly a principal object of the present invention to provide a bundle compactor for elongated elements which will provide a bundle not subject to deterioration during shipment.

Another principal object is the provision of such bundle compactor wherein each unit includes a pair of coaxially, pivotally mounted arms which are moved by a single piston-cylinder assembly from an open to a closed position through a crank and toggle links which lock the arms in closed position.

Still another principal object is the provision of such compactor wherein the distal end of at least one of the arms is bifurcated so that the distal end of the other arm may move between the forked end of the one so that the cinch supported by such distal ends will substantially completely encircle the bundle.

Another important object is the provision of such compactor wherein the cinch is symmetrically furcated between the arms so that the compaction force exerted on the bundle when the cinch is tightened will be symmetrical with a plane normal to the axis of the bundle.

Yet another important object is the provision of such compactor wherein fluid pressure means is operative to tighten the cinch when the arms are closed, such fluid pressure means including a cyclically operated pressure intensifier incrementally increasing the pressure and, to a lesser extent, slightly decreasing the pressure until a predetermined maximum pressure is obtained.

Yet another object is the provision of a bundle compactor which may be utilized with automatic stacking machines such as shown in applicant's U.S. Pat. Nos. 3,880,070; 3,880,273; and 3,880,296.

These and other objects and advantages of the invention will become apparent as the following description proceeds.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

BRIEF DESCRIPTION OF THE DRAWINGS

In said annexed drawings:

FIG. 8 is a fragmentary side elevation of the distal ends of the arms and the cinch showing the minimum bundle diameter obtainable; and FIG. 9 is a schematic hydraulic diagram illustrating the operation and controls for the arm operating cylinder and the cinch tightening cylinder for each unit, the latter including the pressure intensifier.

THE ENVIRONMENT, FIG. 1

Figure 1:
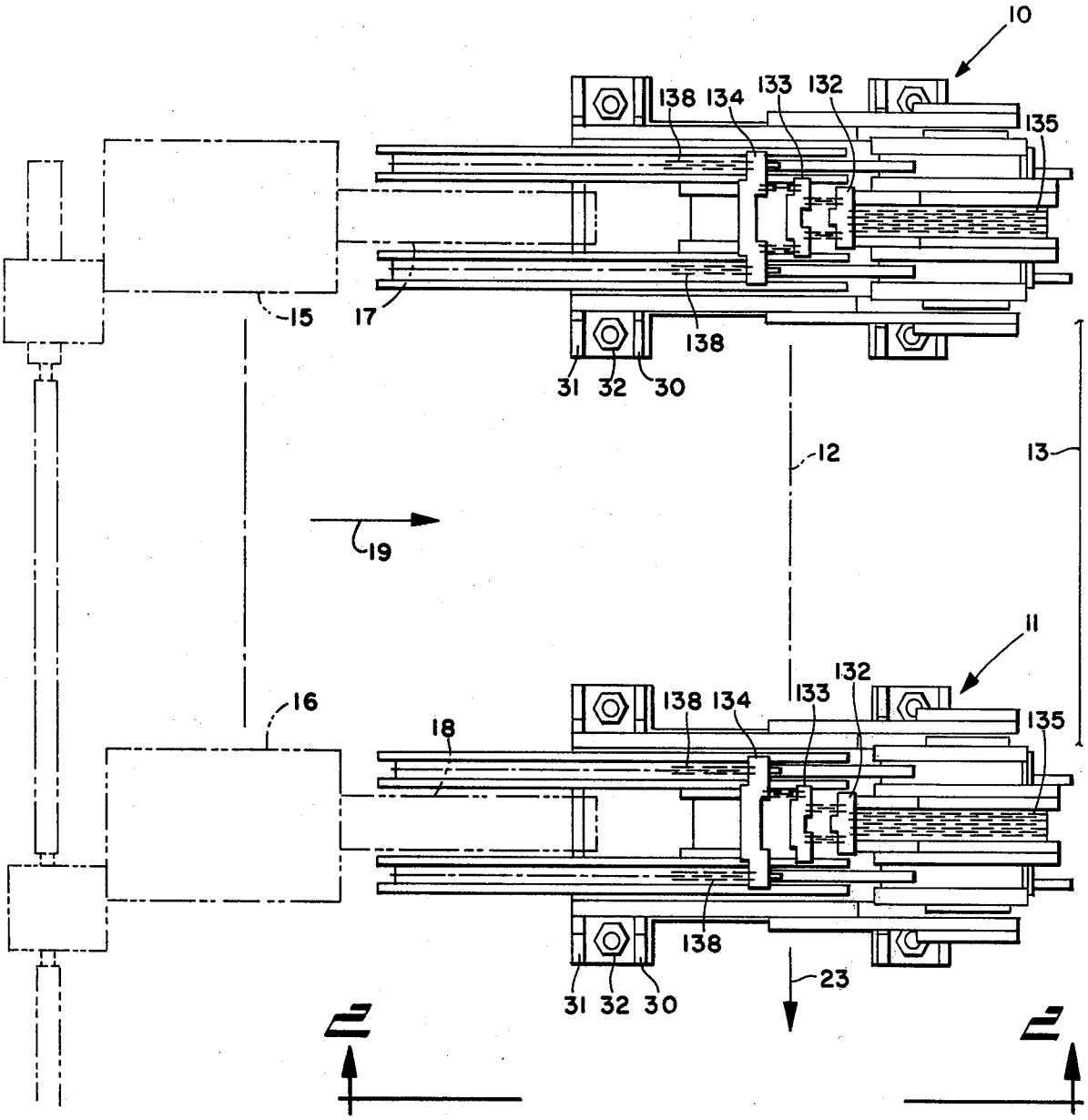
FIG. 1 is a top plan view of a plurality of compacting units in accordance with the present invention.

Referring now to the drawings, and more particularly to FIG. 1, there is illustrated a plurality of compacting units or modules indicated at 10 and 11 which are transversely spaced along the center line 12 of a banding or strapping station. The strapping machines may be mounted on carriages in turn mounted on rails 13 running parallel to the center line of the strapping station.

Figure 2:
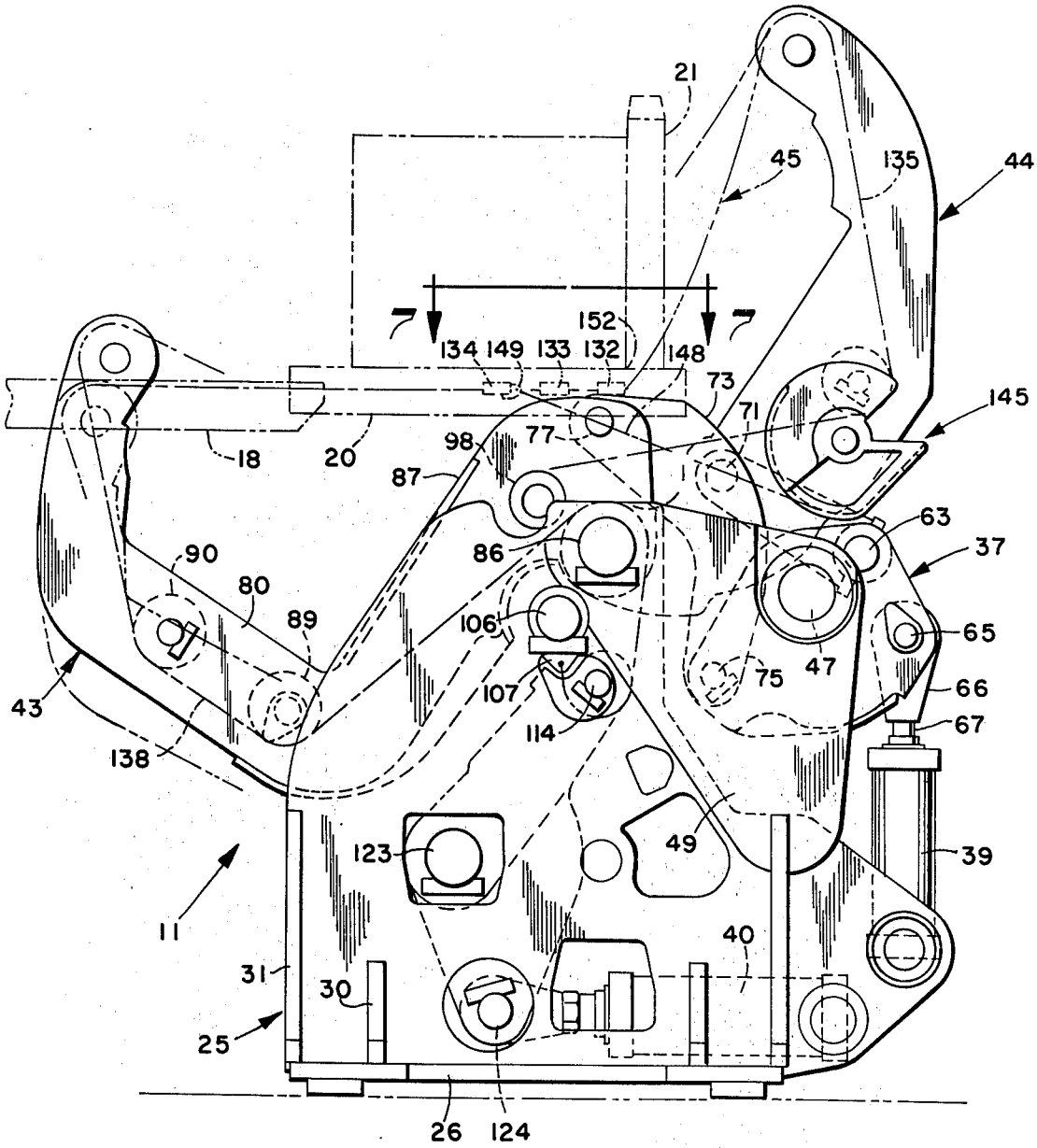
FIG. 2 is a side elevation of one of the compacting units, as seen from the line 2—2 of FIG. 1, with the arms beginning to close.

The elongated elements to be formed into the package may initially be stacked on stacking cradles 15 and 16 aligned with the compacting units 10 and 11. The stacks may be formed, for example, by the automatic stacking machine, shown in applicant's aforementioned U.S. Pat. No. 3,880,273. Each stacking cradle includes at least one pivotally mounted arm which may be pivoted to a horizontal position as indicated at 17 and 18, respectively, to permit the stack formed on the stacking cradles to be transferred horizontally in the direction of the arrow 19 to the center line 12 of the compacting units, also the center line of the strapping station. Such transfer may be accomplished by conveyors, transfers, or overhead cranes, for example. After the stack has been moved to the center line, when the compacting units are open, it will be supported on rolls or other supports 20 as indicated in FIG. 2 against stops or rolls 21. After the compactors have compacted the stack to the desired compactness and the bundle thus formed has been strapped, with the compactors open, the package will be removed from the center line of the strapping station by any suitable means such as an overhead crane for shipment. In a fully automatic line, the packages may be conveyed axially of the center line of the strapping station as indicated by the arrow 23.

Although only two compacting units have been illustrated, it will be appreciated that many more may be provided along the center line 12 of the strapping station. Normally each bundle will be compacted by at least two units, although this may vary depending upon the length of the package being formed. The machine illustrated may handle a wide variety of elongated elements such as bars, angles, flats, channels, beams, rails, tubes, etc. In the case of elements of circular or oval cross section, which are not apt to remain in a stable condition after being stacked, additional supports may be provided in the strapping station. In the case of such unstable elements, the eventual package formed will be of essentially circular cross section.

In any event, since each of the compacting units is of identical construction, only the compacting unit 11 will be described in detail.

COMPACTING UNIT 11 — MAIN BASE FRAME, FIGS. 2–6

Referring now additionally to FIGS. 2 through 6, it will be seen that the compacting unit 11 comprises a main base frame 25 which includes a horizontal base plate 26 which projects laterally of main side plates 27 and 28 at the four corners thereof as seen at 29. Such projections are each reinforced by an inner shorter and outer longer gusset as seen at 30 and 31, respectively. Between each set of gussets, fasteners 32 may be provided extending through feet 33 to secure the unit to the floor 34.

Figure 3:
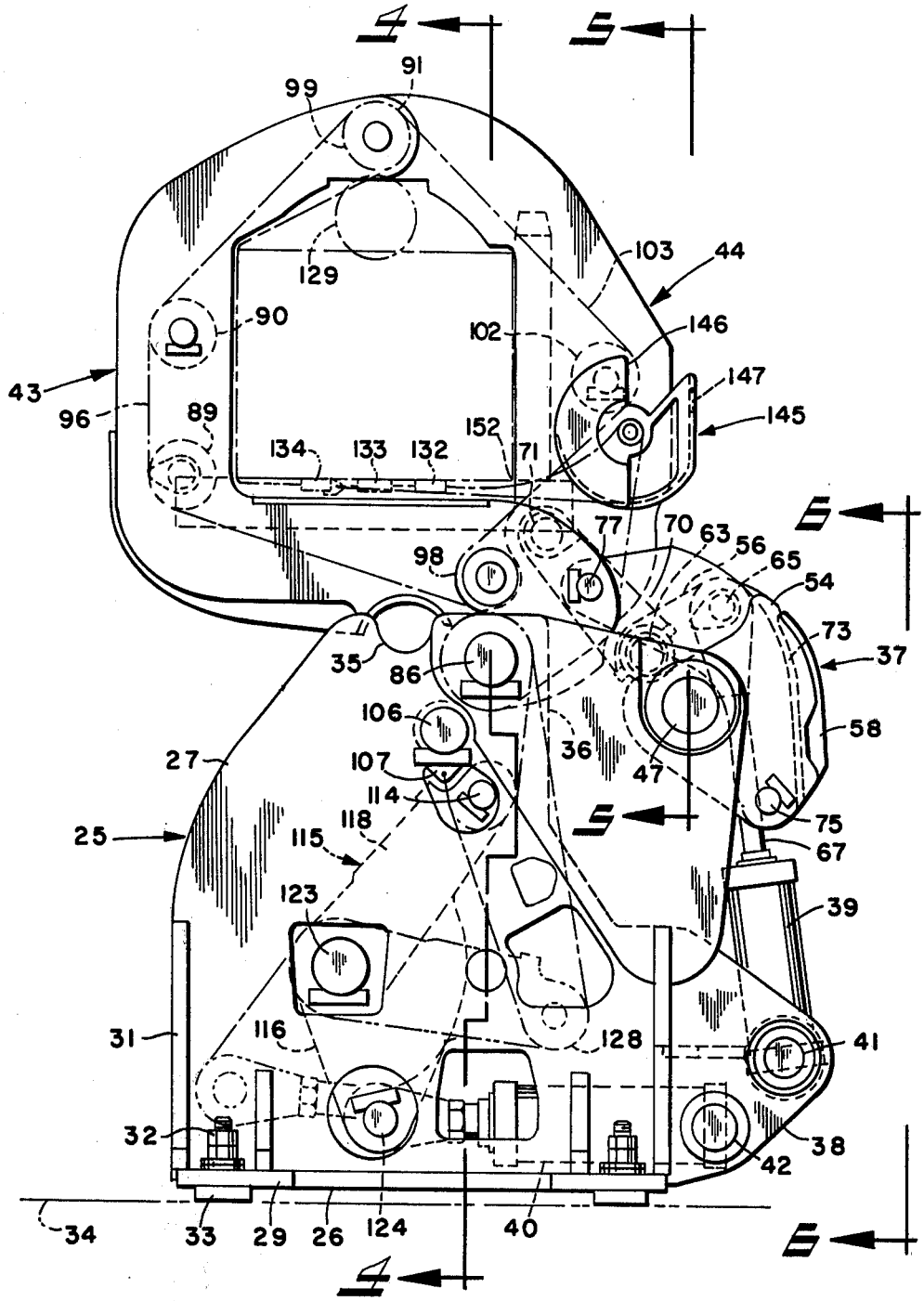
FIG. 3 is a view similar to FIG. 2 but with the arms in their fully closed position.

The profile configuration of the side plates 27 and 28 is best seen in FIG. 3. The top edge of the plates are provided with a recess indicated at 35 which, when the arm assemblies are closed, provides a passage through which a safety bar may be positioned. Such safety bar may be used to hold the arms closed during servicing, repairs, or assembly. From their tops, the side plates descend vertically as indicated at 36 to clear crank 37. Such plates each include a triangular projection 38 between which the blind ends of piston-cylinder assemblies 39 and 40 are pivotally mounted as indicated at 41 and 42, respectively. The piston-cylinder assembly 39 operates the arm assemblies shown generally at 43 and 44 to move the same between open and closed positions as seen in comparing FIGS. 2 and 3. The piston-cylinder assembly 40 is employed to tighten and loosen the chain cinch shown generally at 45 as will be hereinafter described.

Figure 6:
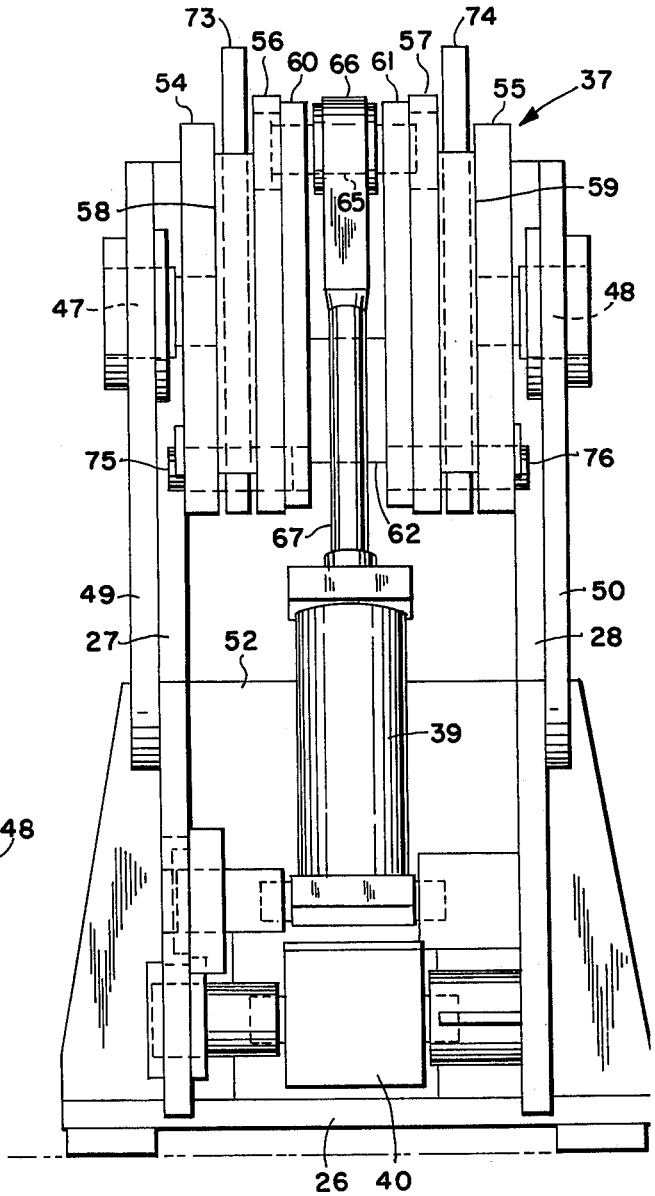
FIG. 6 is an end elevation of the lower portion of the compacting unit as seen from the line 6—6 of FIG. 3.
Figure 6:
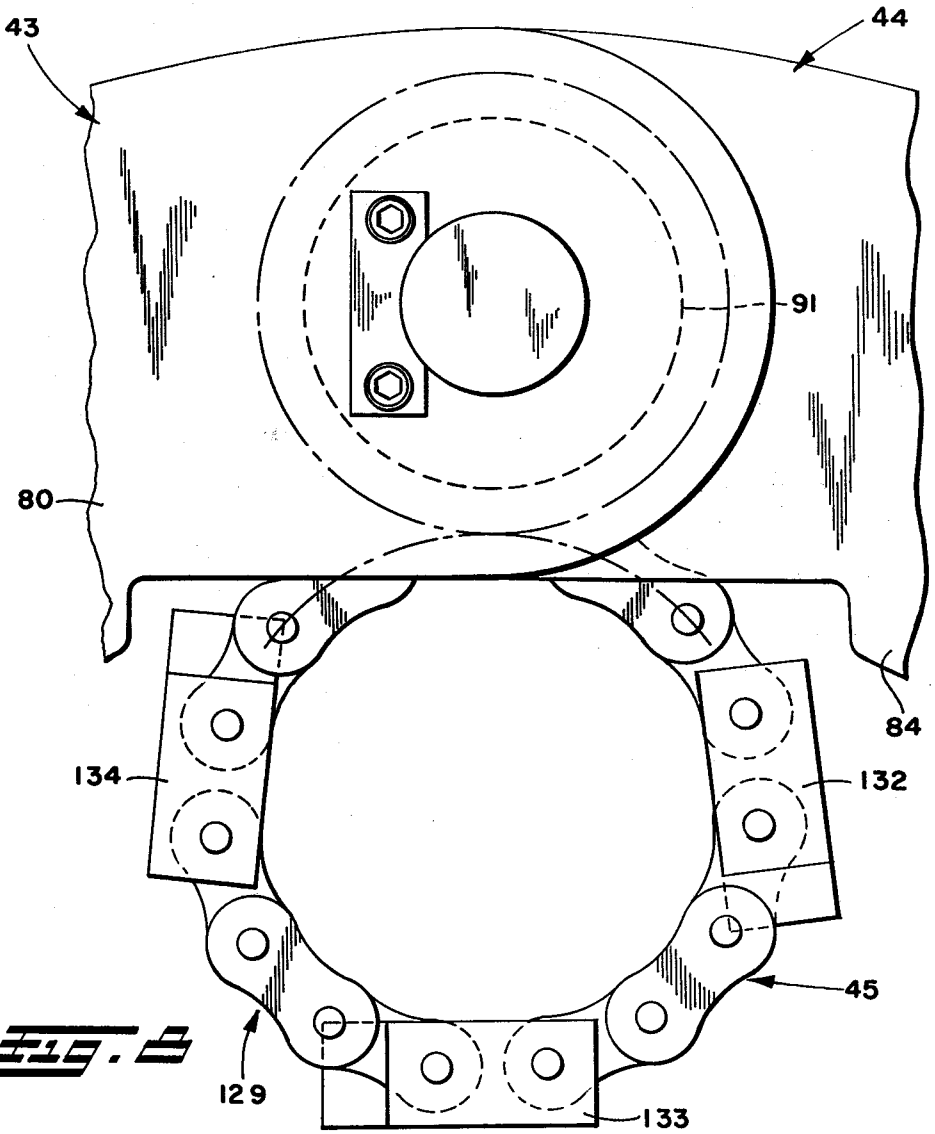

The crank 37 is mounted for oscillating movement on stub shafts 47 and 48 which are in turn supported by side plates 49 and 50 welded to the outside of the main frame plates 27 and 28 as best seen in FIG. 6. The side plates 27 and 28 may be interconnected by transverse plates at the longer gussets 31, one of such plates 52 seen in FIG. 6 extending above the piston-cylinder assembly 40. The base frame thus essentially comprises the main side plates 27 and 28, the side plates 49 and 50, and the base plate 26. Such base frame is preferably in the form of a fabricated weldment.

ARM OPERATING TOGGLE CRANK 37, FIGS. 2, 3, 5 AND 6

The crank 37, best seen in FIGS. 2, 3, 5 and 6, is a rather complex weldment formed of a series of parallel plates. The two outside plates 54 and 55 are journalled on the stub shafts 47 and 48, respectively. Each of such outer plates is spaced from and yet connected to intermediate plates 56 and 57, by relatively small somewhat arcuate bridge blocks 58 and 59, respectively. Such bridge blocks have the profile configuration best seen in FIG. 3. The cutout shown in FIG. 3 for the exterior plate 54 is for ease of chamfer and fillet welding.

The intermediate plates 56 and 57 are welded to parallel interior, yet spaced, plates 60 and 61, respectively. The interior parallel plates are joined by relatively small web 62 and pin 63. A removable pin 65 also extends between the inner plates to which is connected the eye 66 of the rod 67 of the piston-cylinder assembly 39.

Connected to the fixed pin 63 by means of the split flanged bearing indicated is link 70, the opposite end of which is pivotally connected at 71 to the arm assembly 44. Two crescent-shape links 73 and 74 connect the crank with the arm assembly 43, such links being connected by pins 75 and 76, respectively, to the crank, and by pins 77 and 78 to the arm assembly 43. The pins 75 and 76 extend between the spaced outer plates 54 and 55 on the one hand and the intermediate plates 56 and 57 on the other hand. The interior of the bridge blocks 58 and 59 is designed to clear the crescent shape links in the closed position of the arms as seen in FIG. 3. The profile configuration of such links is perhaps best seen in FIG. 2.

ARMS 43 AND 44, FIGS. 2, 3, 4 AND 5

Figure 4:
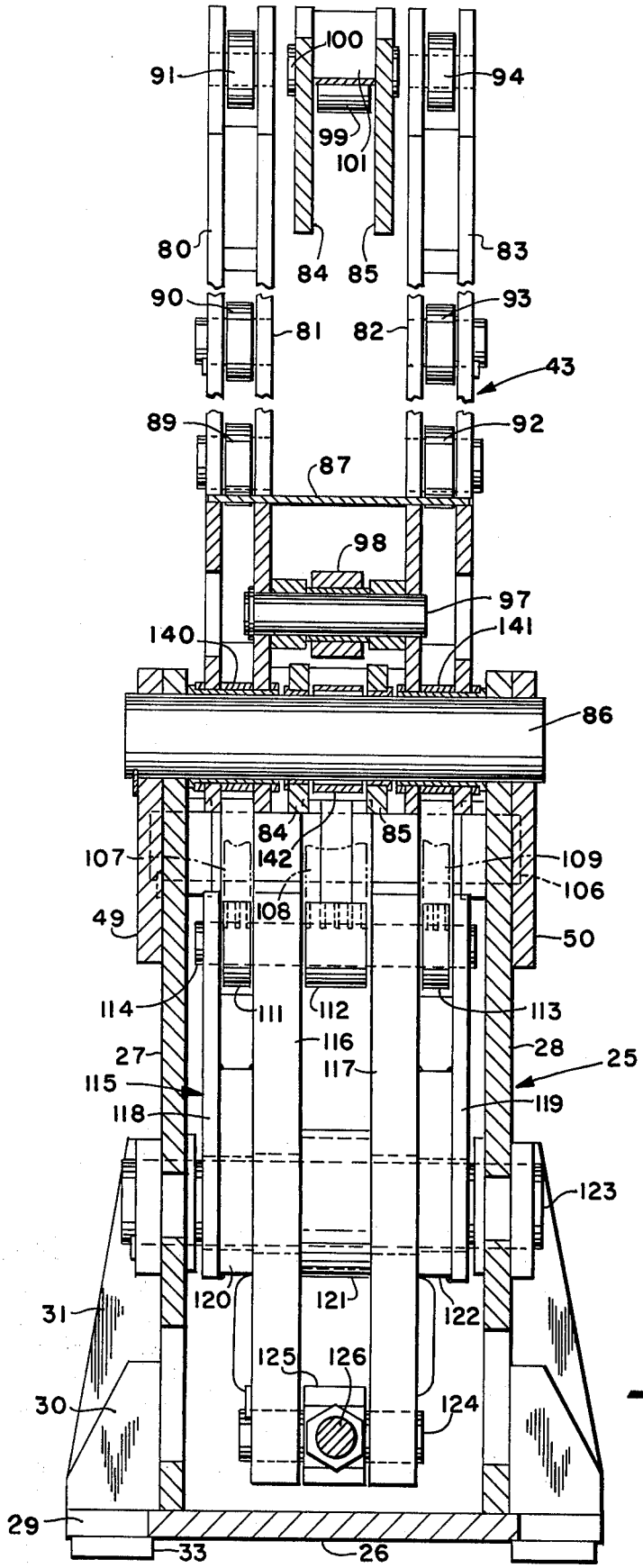
FIG. 4 is an enlarged vertical section taken substantially on the line 4—4 of FIG. 3 and partially broken away.
Figure 5:
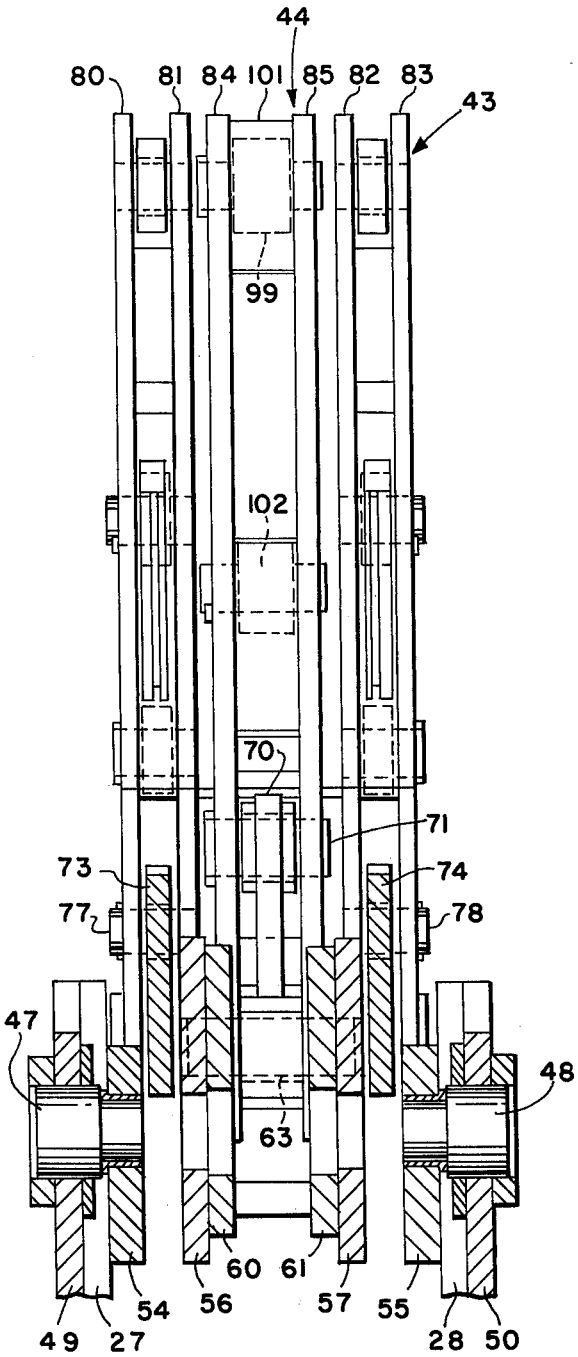
FIG. 5 is a fragmentary vertical section similar to FIG. 4 taken substantially on the line 5—5 of FIG. 3.

As can be seen in FIG. 5, the arm assemblies 43 and 44 are designed so that the former is actually split or bifurcated so that the forked distal ends thereof will accommodate the distal end of the arm 44 therebetween. Thus the arm assembly 43 is fabricated from four parallel plates indicated at 80, 81, 82 and 83, the first two being paired to form one fork of the arm while the last two are also paired to form the other fork. The single arm assembly 44 is also fabricated from two parallel plates 84 and 85. Such arm plates have the profile configuration seen more clearly in FIGS. 2 and 3, and each are coaxially pivotally mounted on bushings on shaft 86 as seen in greater detail in FIG. 4. The shaft is supported by the main base frame 25 at the upper end thereof.

The two forks or tines of the arm assembly 43 may be interconnected by various structural plates such as the bridge plate 87 which is in a horizontal position when the arms are closed. The paired plates 80, 81, 82, and 83 may be interconnected by various structural members designed to facilitate the guiding of the bifurcated end of chain cinch 45 around the outside of rolls 89, 90 and 91 supported between the plates 80 and 81, and the rolls 92, 93 and 94 supported between the plates 82 and 83. The rolls 91 and 94 are journalled on pins flush with the plates which may be locked by threaded keys at the distal ends of the bifurcated arm 43. The path of the bifurcated portion of the cinch is illustrated at 96 in FIGS. 2 and 3 as it moves around the outside of the rolls 89, 90 and 91.

Extending between plates 81 and 82 as seen in FIG. 4 is a removable pin 97 on which is centered and journalled a cinch roller 98. The roller 98 is the same width as and is in the same vertical plane as roller 99 journalled on pin 100 at the distal end of the plates 84 and 85 of arm 44. A cinch guide 101 interconnects the plates 84 and 85. The rolls 98 and 99 are also the same width as cinch guide roller 102 journalled between the plates 84 and 85 as seen, for example, in FIGS. 2 and 3. The path of the cinch extending about the rolls 98, 102 and 99 is seen at 103 in FIG. 3.

It is noted that the interior profile of the arms may be such as to accommodate initially square or rectangular stacks which may become generally circularized upon compaction when lifted by the cinch as it is tightened. Thus when closed, the opening defined by the arms is in the general form of a square with a somewhat circular top, the circular top edge being essentially tangent to the outer side of the cinch when wrapped around the rolls 91, 99, and 94.

THE CINCH ANCHOR, FIGS. 2, 3 AND 4

Immediately below and slightly offset from the arm pivot shaft 86, the main base frame supports parallel cinch anchor shaft 106. Since the cinch is in the form of a link chain, as hereinafter described, the cinch anchors simply comprise anchor blocks on the anchor shaft pin connected to the end chain links. The anchor blocks for the cinch ends are seen in dotted lines in FIG. 4 at 107, 108 and 109. The center anchor block 108, as seen, is centered between and wider than the two outer anchor blocks 107 and 109. The reason for the variation in width is that the chain connected to the anchor block 108 is twice as wide as the chains connected to the anchor blocks 107 and 109 as will be seen by momentarily referring to FIG. 7.

Figure 7:
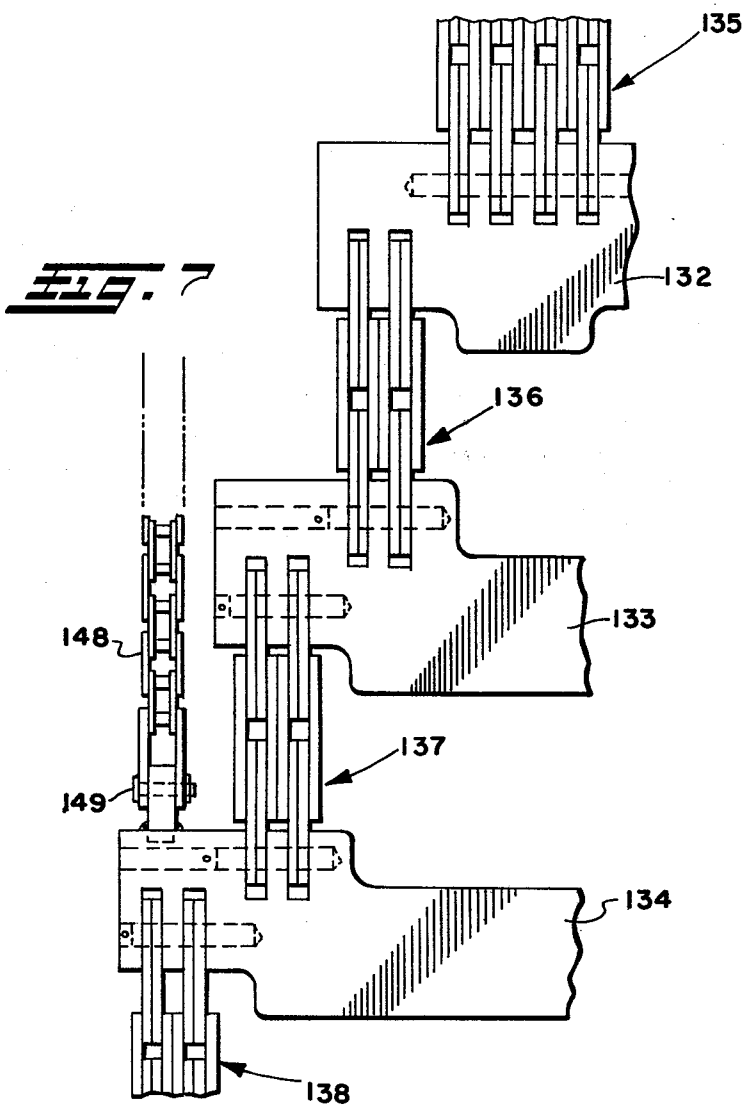
FIG. 7 is an enlarged detail view broken away of the transition bars or links by which the chain cinch is bifurcated to obtain symmetrical compaction.
Figure 5:
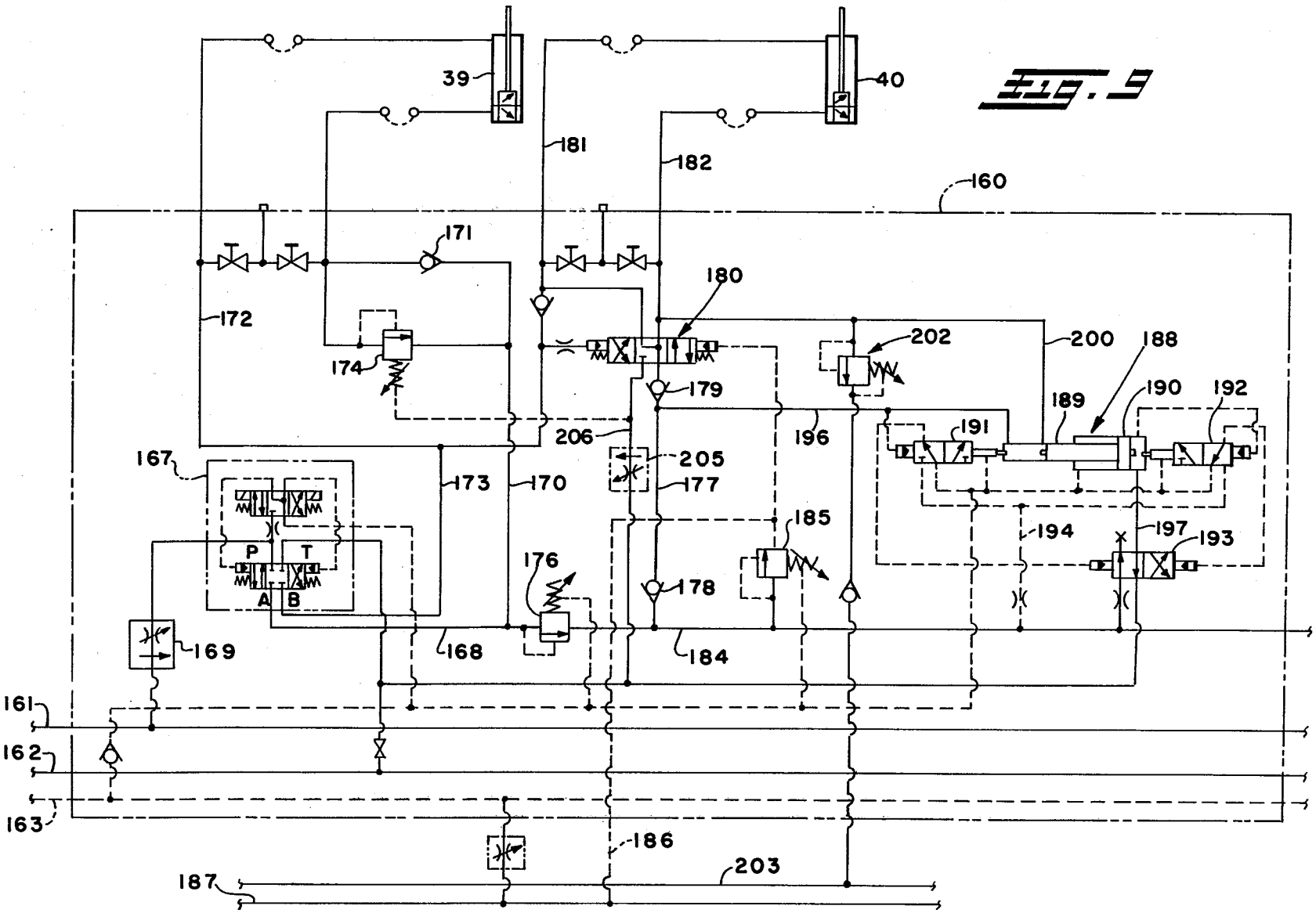

A comparison of FIG. 7 with FIG. 4 will also explain the variation in width between the rolls 91 and 94, on the one and, and 99 on the other.

From the anchor blocks 107, 108 and 109, the chains pass around rolls 111, 112 and 113 which are journalled on shaft 114 at one end of cinch takeup bell crank 115.

CINCH TAKEUP 115, FIGS. 2, 3 AND 4

As seen in FIG. 4, the takeup bell crank includes two spaced main parallel plates 116 and 117, and two outboard, somewhat thinner, plates 118 and 119 spaced from the plates 116 and 117, respectively. The profile configuration of the plates 118 and 116 is shown in FIG. 3. All of the plates are interconnected by spacers seen at 120, 121 and 122 so that all of the plates and spacers surround the main support pin 123 extending through the side plates 27 and 28 of the base frame. The lower projecting ends of the main plates 116 and 117 are connected by removable pin 124 on which is mounted the eye 125 of the rod 126 of piston-cylinder assembly 40. Extension of the piston-cylinder assembly 40 under pressure will thus move the pin 114 and the rollers mounted thereon, if fully extended, to the phantom line position 128 seen in FIG. 3. When thus fully extended, the portion of the chain cinch pendently supported by the distal ends of the arms will achieve its smallest diameter as seen at 129 in FIG. 3, and in detail in FIG. 8.

CINCH CHAIN 45, FIGS. 7 AND 8

Referring now to FIGS. 7 and 8, it will be seen that the cinch 45 may comprise a conventional leaf chain constructed of hardened side plates and pins. The side plates, for example, may have a pitch of 38.10 mm, a plate height of 30.96 mm, and a nominal thickness of 4.75 mm. The pins may have a nominal diameter of 11.10 mm. Intermediate the distal ends of the arm assemblies, the chain cinch is provided with three transition links or spreader bars seen at 132, 133 and 134 in FIGS. 7 and 8, and also shown in FIG. 1. Such spreader bars, although not necessarily equidistant from the cinch anchors, are designed to be equidistant from the distal ends of the arms so that they will symmetrically underly the bundle or package being formed. From the spreader bar 132 to the anchor 108 seen in FIG. 4, the chain cinch has an 8 × 8 lacing. Thus there are 8 side plates extending between adjacent pins. The detail of the chain cinch from the spreader bar 132 to the anchor 108 is seen at 135 in FIG. 7. The spreader bar 132 is connected to the intermediate spreader bar 133 by two 4 × 4 chains as indicated at 136 spread from the center of the 8 × 8 chain 135 approximately 63.50 mm. Similarly, two 4 × 4 chains 137 interconnect the spreader bar 133 with the spreader bar 134. The centers of chains 137 may be approximately 10.79 cm from the center of the 8 × 8 chain 135. Finally, 4 × 4 chains 138 extend from the ends of the spreader bar 134 to the anchors 107 and 109 as seen in FIG. 4. The 4 × 4 chains 138 are spread in this manner approximately 15.24 cm from the center of the 8 × 8 chain 135. The offset structure of the transition links is designed to provide the structural strength required in the area of the pins and side plates, and to resist bending moments under full load.

The chain cinch is accordingly bifurcated symmetrically between the distal ends of the arms in the same manner that the arm 43 is bifurcated with respect to the arm 44. Not only does the above-described construction of the arms and chains permit the distal end of the arm 44 to move between the distal ends of the arm 43 to permit the chain cinch completely to encircle the bundle, but the bifurcation also uniformly distributes the compaction force about a plane normal to the axis of the bundle avoiding any twisting force on the bundle. It will be appreciated that other arrangements may be provided. For example, the arm 44 itself might be bifurcated while the arm 43 is trifurcated. The uniform application of force and the complete encirclement can in this manner also be accomplished. When the arms are closed, the rolls 91, 99 and 94 may be at least axially aligned.

THE CHAIN CINCH PATH, FIGS. 2, 3 AND 4

Now, tracing the path of the portions of the chain cinch, it will be seen that one of the 4 × 4 chains 138 is connected to the anchor 107. The chain then extends downwardly about the roll 111 in the chain takeup seen in FIGS. 2, 3 and 4. The chain then extends upwardly over roll 140 journalled on main pivot shaft 86 between the arm plates 80 and 81. Such chain 138 continues around the outside of guide rolls 89 and 90 in one leg of the arm 43. The chain continues over the top of roll 91 in the distal end of such one leg of the arm 43 and is connected to the spreader bar 134 as indicated in FIG. 7. The opposite 4 × 4 chain 138 connected to such spreader bar 134 is anchored at 109 and similarly extends around roll 113 of the chain takeup, and then around roll 141 on shaft 86, thence around the outside of rolls 92 and 93 in the other leg of the arm 43, and finally over the roll 94 at the distal end thereof to be connected to the other end of the spreader bar 134.

The 8 × 8 chain 135 is anchored at 108 and extends downwardly around the somewhat wider roll 112 of the chain takeup and then upwardly over roll 142 journalled on the center of the main pivot pin 86. As seen in FIGS. 2 and 3, the 8 × 8 chain then wraps around roll 98, thence around roll 102 in the arm 44 and finally around roll 99 in the distal end thereof to be connected to the spreader bar 132 as indicated in FIG. 7.

It is noted that the path of the rolls 111, 112 and 113, when moved by the piston-cylinder assembly 40 to the position 128 seen in FIG. 3, is essentially away from the anchor pin 107 and the shaft 86 on which the rolls 140, 142 and 141 are journalled. In this manner the chain moves essentially twice as far as the takeup 115 to be uniformly tightened from the distal end of each arm.

COUNTERWEIGHT 145, FIGS. 2 AND 3

Referring now to FIGS. 2, 3 and 7, it will be seen that each side of the arm 44 is provided with a rotatable counterweight indicated generally at 145. The counterweight is the semicircular portion 146 and a relatively small chain is connected to the opposite portion at 147. Thus the counterweight tends to rotate in a counterclockwise direction as seen in FIGS. 2 and 3. A chain 148 extends from its connection 147 along a track and tangentially from the bottom of the counterweight to be connected at 149 to the transition link 134 as seen in detail in FIG. 7. The purpose of the counterweight and takeup chain is to distort the loop formed by the cinch when the arms are open pulling the lower end of the loop toward the right as seen in FIG. 2, for example, so that the cinch will clear the bottom corner of the envelope of the largest package to be bundled as indicated at 152. This then permits the compacted and banded bundle to be transported axially in the direction of the arrow 23 seen in FIG. 1 without becoming entangled with the chain cinch.

TOGGLE CRANK OPERATION

It is noted that each compacting unit comprises but two hydraulic piston-cylinder assemblies, one to open and close the arms, and the other to tighten the chain cinch about the bundle when the arms are closed and the chain cinch has encircled the bundle. In order to avoid one cylinder acting against the other, the arms are each locked in their closed position by a toggle arrangement afforded by the construction and operation of the crank 37 and the links connected thereto. As seen in comparing FIGS. 2 and 3, it will be noted that the centers for the pins 63 and 75 are aligned with the centers for the stub shafts 47 and 48. As the piston-cylinder assembly 39 fully extends, and the crank rotates counterclockwise as seen in FIG. 3, the centers for the pins 77 and 78 on the arm 43 may move slightly beyond a line through the centers 75, 47 and 63. Also, the pins 71 may move slightly over-center clockwise of such alignment. Therefore, in the fully closed position of the arms, the pins 77–78 and 71 are slightly over center. The arms are then locked in closed position and can be unlocked only by retraction of the piston-cylinder assembly 39. Thus, any force exerted by the chain on the arms will not be transmitted to the hydraulic system.

HYDRAULIC CONTROL, FIG. 9

The hydraulic controls for each compacting unit are seen in FIG. 9. Since there are a plurality of such compacting units, they may be operated from common pump or pressure-accumulator systems, tanks, filters, coolers, etc. However, each unit may have its own control valves, and these may be mounted in a manifold as indicated at 160. The connections indicated at 161, 162, and 163 may connect the manifold to a pressure and accumulator system, to tank through filters and coolers, and directly to tank, respectively. Assuming that the stacking cradle or other suitable mechanism has positioned a stack to be compacted in the center line of the strapping station with the arms fully opened, the cycle is commenced by actuation of the solenoid, three-position, pilot operated, control valve indicated at 167. When the control valve 167 shifts at the commencement of the cycle, it supplies hydraulic pressure to line 168 from line 161 through flow control valve 169. Line 170 connects the fluid pressure to the blind end of piston-cylinder assembly 39 through check valve 171. The rod end of the piston-cylinder assembly 39 is connected through line 172 which returns the fluid to tank through line 173 through the control valve 167. A sequence valve 174 is provided in parallel with the check valve 171.

When the piston of piston-cylinder assembly 39 achieves its cushion zone at the end of its stroke moving the arms into toggle locked position, the pressure in line 170 increases opening sequence valve 176. Such sequence valve opens at its set pressure to start the chain takeup when the arms are closed and the toggle is locked. The opening of the valve 176 supplies fluid pressure to line 177 through check valves 178 and 179, and through three position control valve 180, which when centered, opens both lines 181 and 182 connected to the rod and blind ends, respectively, of the piston-cylinder assembly 40. In this manner, a regenerative circuit is formed so that the rod of the piston-cylinder assembly 40 will move initially in a fast traverse mode due to the area differential between the rod and blind end of the piston. During such fast traverse, the chain takeup piston-cylinder assembly 40 may actually lift a light bundle.

The opening of sequence valve 176 also supplies fluid pressure to line 184 and when sufficient pressure is obtained, valve 185 opens shifting control valve 180 to the left as seen in FIG. 9 taking the piston-cylinder assembly 40 out of its fast traverse mode. The valve 185 also pressurizes pilot line 186 which in turn pressurizes common pilot line header 187 which is designed to ensure that each unit will be shifted from its fast traverse mode essentially simultaneously.

The opening of sequence valve 176 also provides fluid pressure to pressure intensifier 188. The pressure intensifier comprises a ram or rod 189 driven to the left as seen in FIG. 9 by somewhat larger piston 190. Pressure-mechanical pilot valves 191 and 192 are shifted at opposite ends of the stroke of the ram which in turn shift the position of pilot operated valve 193. Pilot pressure for such valves is supplied through line 194.

In operation, pressure in the line 196 causes the ram to move to the right as seen in FIG. 9 shifting the pilot valve 192 mechanically. This in turn shifts the control valve 193 supplying pressure from the line 184 to the blind end of the piston 190 through the line 197. The ram now moves to the left as seen in FIG. 9 forcing fluid into the line 196 which can only move through the check valve 179 thus increasing the pressure in line 182. When the ram 189 reaches the end of its stroke, it shifts the valve 191 which in turn shifts valve 193 permitting pressure in line 177 entering through check valve 178 to move the ram to the right. Pressure in line 182 will be held until the ram uncovers the port to line 200 slightly relieving the pressure in line 182.

The cyclical operation of the pressure intensifier continues at a frequency of several times per second, and during each cycle, the intensifier is operative to increase and decrease the pressure in a ratio of about 3:1, respectively. The pressure continues to build up in line 182 and, of course, in line 200, until relief valve 202 opens pressurizing compaction complete signal header 203. A suitable pressure switch or switches in the header then signal the completion of the compaction permitting the strapping machines then to complete their programmed cycle securely strapping the bundles while held compacted.

The pressure intensifier enables the system to achieve a higher compression pressure than that which could be obtained from the pump or pressure accumulator system alone. For example, the pressure obtainable with the pressure intensifier may be two or more times greater than that obtainable without the pressure intensifier. Moreover, the impact, vibration or jolt action obtained by the intensifier, alternating with a slight relieving of the pressure, permits the elements of the bundle to shift slightly during compaction thus achieving a bundle of optimum density and compactness.

When the strapping machines have completed their programmed cycle, the control valve 167 is shifted connecting line 168 to line 162 which leads to the tank through suitable filters and coolers. Pressure is also applied to the line 173 causing the control valve 180 to shift, and both piston-cylinder assemblies 39 and 40 to retract. Flow control valve 205 controls the retraction speed of piston-cylinder assembly 40 and thus the cinch or chain loosening speed. Back pressure in line 206, which persists until cylinder 40 piston fully retracts, keeps sequence valve 174 from opening. This ensures that the chain cinch will be fully slack before the arms open.

When the arms are fully opened, the counterweight assembly 145 will distort the cinch loop clearing the thus formed bundle for removal axially of the machine. The controls are sufficiently simple that the compaction unit can readily be fully automated and operated in conjunction with stacking and strapping machines.

It can now be seen that there is provided a bundle compactor which will form a secure and compact bundle of elongated elements.

I, therefore, particularly point out and distinctly claim as my invention:

1. A bundle compactor for elongated elements comprising two arm assemblies mounted for movement between open and closed positions, a flexible element extending between the distal ends of said arm assemblies and in the closed position thereof encircling the bundle, the distal end of at least one of said arm assemblies being furcated symmetrically with respect to the distal end of the other arm assembly so that such distal ends may interfit, and said flexible element being furcated accordingly, whereby, when said flexible element is tightened when said arm assemblies are closed, the compacting force will be evenly distributed about a plane normal to the axis of the bundle.

2. A compator as set forth in claim 1 wherein said one of said arm assemblies is bifurcated.

3. A compactor as set forth in claim 2 wherein said flexible element comprises a chain which is bifurcated intermediate the distal ends of said arms.

4. A compactor as set forth in claim 3 wherein said chain includes a plurality of transition links successively symmetrically spreading the bifurcated portion of said chain.

5. A compactor as set forth in claim 4 wherein said chain is a leaf chain, the lacing of each strand of the bifurcated portion being one half that of the non-bifurcated portion.

6. A compactor as set forth in claim 4 wherein each transition link includes an offset adjacent the bifurcated portion of the chain connected thereto.

7. A compactor as set forth in claim 1 including rolls journalled at the distal ends of said arms over which said flexible element is trained, and a common anchor for the ends of said flexible element.

8. A compactor as set forth in claim 7 wherein said arm assemblies are coaxially pivotally mounted, and rolls journalled on said arm pivot, said flexible element also being trained over said arm pivot rolls.

9. A compactor as set forth in claim 8 including means to tighten said flexible element by increasing the path thereof between said anchor and said arm pivot rolls.

10. A compactor as set forth in claim 9 wherein said last-mentioned means comprises a bell crank, and rolls on said bell crank corresponding to said arm pivot rolls around which said flexible element is trained.

11. A compactor as set forth in claim 10 including a piston-cylinder assembly operative to move said bell crank to lengthen such path thus to tighten said flexible element.

12. A compactor as set forth in claim 11 including a pressure intensifier for said piston-cylinder assembly operative incrementally to increase the pressure to tighten the flexible element to a predetermined maximum pressure.

13. A compactor as set forth in claim 12 wherein said pressure intensifier is cyclically operated to increase to a greater extent and decrease to a lesser extent the pressure during each such cycle of operation.

14. A compactor as set forth in claim 13 wherein the increase and decrease is in a ratio of about 3 to 1, respectively.

15. A compactor as set forth in claim 1 wherein said arm assemblies are coaxially pivotally mounted.

16. A compactor as set forth in claim 15 including a pivotally mounted crank operative to open and close said arm assemblies.

17. A compactor as set forth in claim 16 including respective links connecting said crank and each arm assembly, the respective links being pivotally connected to said crank on diametrically opposite sides of said crank pivot, whereby said respective link-crank connections and crank pivot are aligned.

18. A compactor as set forth in claim 17 wherein the respective link connections to said arm assemblies are each slightly oppositely over-center of such alignment when said arms are closed whereby said arms are toggle locked in closed position.

19. A compactor as set forth in claim 18 including a piston-cylinder assembly connected to said crank operative to rotate the same to close and toggle lock said arm assemblies when extended and to unlock and open said arm assemblies when retracted.

20. A compactor as set forth in claim 15 including means to toggle lock said arm assemblies in closed position.

21. A flexible cinch for a compactor comprising a chain having an intermediate furcation whereby one end of said chain will symmetrically interfit with the other, and at least one transition link symmetrically spreading the furcated portion of said chain, said transition link including an offset in the direction of the chain adjacent the furcated portion connected thereto.

22. A cinch as set forth in claim 21 wherein said furcation is a bifurcation.

23. A bundle compactor comprising a pair of arms mounted for movement from an open to a closed position, a flexible cinch supported by the distal ends of said arms and adapted to encircle the bundle when said arms are closed, and fluid pressure means operative to tighten said cinch when said arms are closed, said fluid pressure means including a pressure intensifier operative incrementally to increase the pressure to tighten the cinch to a predetermined maximum pressure.

24. A compactor as set forth in claim 23 wherein said pressure intensifier is cyclically operated to increase and then decrease to a lesser degree the pressure during each such cycle of operation.

25. A compactor as set forth in claim 24 wherein the increase and decrease is in a ratio of about 3 to 1, respectively.

26. A compactor as set forth in claim 25 wherein said pressure intensifier comprises a piston operated ram operative to force fluid through one check valve on one stroke and to receive fluid through another check valve on the return stroke.

27. A compactor as set forth in claim 26 including a by-pass line around said one check valve slightly relieving the pressure beyond said one check valve as said rams near the end of its return stroke.

28. A flexible cinch for a compactor comprising a chain bifurcated intermediate the ends thereof whereby one end of said chain will symmetrically interfit with the other, and a plurality of transition links each successively symmetrically spreading the furcated portion of the chain.

29. A cinch as set forth in claim 28 wherein each transition link includes an offset adjacent the furcated portion connected thereto.

30. A bundle compactor comprising a pair of arms coaxially pivotally mounted for movement between an open and closed position, a flexible cinch trained over the distal ends of said arms and encircling the bundle when said arms are closed, toggle link means operative to hold said arms in closed position, a pivotally mounted crank operative to open and close said arms, and respective links connecting said crank and each arm, the respective links being pivotally connected to said crank on diametrically opposite sides of said crank pivot, whereby said respective crank-link connections and crank pivot are aligned.

31. A compactor as set forth in claim 30 wherein the respective link connections to said arms are each over-center of such alignment when said arms are closed.

32. A compactor as set fort in claim 31 wherein the crank throw for and length of the respective links pivots one arm a greater extent than the other.

33. A compactor as set forth in claim 32 wherein said one arm is pivoted approximately 90° so that a stack of elements to be compacted may be moved horizontally into the compactor.

34. A compactor as set forth in claim 33 wherein said one arm is connected to said crank by two links, said links being crescent-shape to clear the coaxial pivotal mounting of said arms.

35. A bundle compactor for elongated elements comprising a pair of arms mounted for pivotal movement between an open and closed position, a flexible cinch trained over the distal ends of said arms and completely encircling the bundle when said arms are closed, first fluid pressure means operative to open and close said arms, and second fluid pressure means operative uniformly to tighten said cinch from the distal end of each arm when said arms are closed, said second fluid pressure means including a pressure intensifier operative incrementally to increase the pressure to tighten said cinch to a predermined maximum pressure.

36. A bundle compactor for elongated elements comprising a pair of arms mounted for pivotal movement between an open and closed position, at least one of said arms being furcated symmetrically to interfit with the other in closed position, a flexible cinch trained over the distal ends of said arms and completely encircling the bundle when said arms are closed, first fluid pressure means operative to open and close said arms, and second fluid pressure means operative uniformly to tighten said cinch from the distal end of each arm when said arms are closed.

37. A bundle compactor comprising a pair of arms, at least one being mounted for movement between an open and closed position, a flexible cinch extending between and trained over the distal ends of said arms, common anchor means for both ends of said cinch, a crank, an idler roll mounted on said crank around which said cinch is trained, and means to pivot said crank thus to move said idler roll away from said anchor means to increase the path of said cinch between said anchor means and the distal ends of said arms thereby to tighten said cinch.

38.A compactor as set forth in claim 37 wherein said idler roll is mounted on an arm of said crank.

39. A compactor as set forth in claim 38 including a piston-cylinder assembly operatively connected to another arm of said crank pivotally to move said crank to move said idler roll away from said anchor.

40. A compactor as set forth in claim 39 including a pressure intensifier for said piston-cylinder assembly operative incrementally to increase the pressure in said piston-cylinder assembly to tighten said cinch to a predetermined maximum pressure.

* * * * *